US007933767B2

(12) United States Patent
Ojanperä

(10) Patent No.: US 7,933,767 B2
(45) Date of Patent: Apr. 26, 2011

(54) SYSTEMS AND METHODS FOR DETERMINING PITCH LAG FOR A CURRENT FRAME OF INFORMATION

(75) Inventor: Juha Ojanperä, Nokia (FI)

(73) Assignee: Nokia Corporation, Espoo (FI)

( * ) Notice: Subject to any disclaimer, the term of this patent is extended or adjusted under 35 U.S.C. 154(b) by 844 days.

(21) Appl. No.: 11/022,610

(22) Filed: Dec. 27, 2004

(65) Prior Publication Data

US 2006/0143002 A1 Jun. 29, 2006

(51) Int. Cl.

| | |
|---|---|
| ***G10L 11/04*** | (2006.01) |
| ***G10L 11/06*** | (2006.01) |
| ***G10L 19/06*** | (2006.01) |
| ***G10L 19/00*** | (2006.01) |

(52) U.S. Cl. ..... 704/207; 207/208; 207/209; 207/216; 207/217; 207/218

(58) Field of Classification Search ..... 704/207, 704/216, 218

See application file for complete search history.

(56) References Cited

U.S. PATENT DOCUMENTS

| | | | | |
|---|---|---|---|---|
| 5,774,836 | A | 6/1998 | Bartkowiak et al. | |
| 5,812,967 | A * | 9/1998 | Ponceleon et al. | 704/207 |
| 5,890,108 | A * | 3/1999 | Yeldener | 704/208 |
| 6,199,035 | B1 * | 3/2001 | Lakaniemi et al. | 704/207 |
| 6,243,672 | B1 * | 6/2001 | Iijima et al. | 704/207 |
| 6,470,310 | B1 * | 10/2002 | Oshikiri et al. | 704/207 |
| 6,988,064 | B2 * | 1/2006 | Ramabadran et al. | 704/218 |
| 7,236,927 | B2 * | 6/2007 | Chen | 704/216 |
| 2003/0220787 | A1 * | 11/2003 | Svensson et al. | 704/207 |
| 2004/0073420 | A1 * | 4/2004 | Lee et al. | 704/207 |
| 2004/0093208 | A1 * | 5/2004 | Yin | 704/230 |
| 2004/0181397 | A1 | 9/2004 | Gao | |
| 2005/0091045 | A1 * | 4/2005 | Oh | 704/207 |

FOREIGN PATENT DOCUMENTS

| | | |
|---|---|---|
| EP | 0 745 971 | 12/1996 |
| EP | 0 788 091 | 8/1997 |
| WO | WO 01/03122 * | 1/2001 |

OTHER PUBLICATIONS

Juha Ojanpera, et al. "Long Term Predictor for Tramsform Domain Perceptual Audio Coding." AES Convention 107, No. 5036, pp. 1-10., Sep. 2009.

European Search Report for EP Application No. 05 85 0717 dated Apr. 17, 2009.

* cited by examiner

*Primary Examiner* — James S Wozniak
*Assistant Examiner* — Paras Shah
(74) *Attorney, Agent, or Firm* — AlbertDhand LLP

(57) ABSTRACT

Methods, computer code products, devices, modules, systems, and encoders are disclosed which are configured to use an adaptive lag search window for determining a lag estimate for a current frame of information in an audio encoding system. The system can determine if the lag estimate is reliable and if not a new search window can be selected and a new lag estimate can be calculated based on the new search window. An adaptive threshold can be compared to the cross correlation for a lag estimate in order to determine whether the lag estimate is reliable. The system can also determine if an encoding gain is likely to be achieved using the prediction and if not, the computationally expensive time-to-frequency transformation can be avoided.

25 Claims, 5 Drawing Sheets

SYSTEMS AND METHODS FOR DETERMINING PITCH LAG FOR A CURRENT FRAME OF INFORMATION

FIELD OF THE INVENTION

The present invention relates generally to the field of encoding systems. More particularly, the present invention relates to improved audio coding systems and methods.

BACKGROUND INFORMATION

In many applications, it is desirable to minimize the amount of information needed to represent signals or files. By minimizing the amount of information, bandwidth needed to transmit the signal and/or storage space needed to store the file can be conserved. This can be particularly useful for devices or systems having limited resources, such as mobile communication devices.

One type of signal, which is typically compressed using an encoder is an audio signal. Audio encoders can be used to compress a time domain audio signal such that the bit rate needed to represent the signal is significantly reduced. Ideally, the bitrate of the encoded signal is reduced such that it fits the constraints of a transmission channel used to transmit the signal. This can be particularly useful for real-time communication and streaming services application. The size of an file representing the encoded audio signal can also be reduced using compression. This can be particularly useful for downloading and/or storing high quality audio content. Typically an audio encoder aims to minimize the perceptual distortion at any given bitrate or compressed file size. However, the lower the bitrate or the more compression applied to a file, the more challenging it is to the encoder to satisfy these two conditions. Typically it is the (encoding) performance with the worst-case signals (signals that are difficult to encode) that ultimately defines the overall performance of any encoding system. Another factor in defining the overall performance of any encoding system is the encoding speed and resources needed to encode the signal.

Many encoding techniques and encoders currently exist, however one problem with existing techniques and encoders is that they are slow. Another problem that is often encountered with existing techniques is that they require an extraordinary amount of resources such as memory. While this may not be a problem in research conditions, for commercial use and especially for mobile use, encoding speed and resource requirements can become important considerations.

Advanced Audio Coding (AAC) is an example of one audio encoding system which can be used to generate high quality audio files. AAC, the successor to MP3, is a wideband audio coding algorithm that is can be used for generating high quality audio files. AAC exploits two coding strategies to reduce the amount of data needed to convey high-quality digital audio. The signal components that can not be perceived are removed and redundancies in the encoded signal are eliminated. AAC generally supports two frequency resolutions, 128-point and 1024-point modified discrete cosine transform (MDCT). The former can be used for efficient handling of transient signal segments and the latter can be used when (quasi)-stationary signal segments are present to achieve high energy compaction.

AAC offers an extensive set of encoding tools which can be used to attempt to maximize the subjective audio quality under various encoding conditions. AAC operates using profiles which can define a subset of tools that can be used for encoding a signal.

One such profile, AAC Long-Term Prediction (LTP), can be used for modeling tonal signal segments and can provide a significant quality improvement in encoding worst-case signal segments. However, similar to other existing encoding techniques, AAC LTP encoders can suffer from very slow encoding speeds. One reason may be that an estimation of LTP lag information is performed which can require a significant amount of computation.

An AAC LTP encoder can be configured so that LTP models long-term correlations by repeating past reconstructed signal segments. One sample transfer function used for LTP can be:

$$B(z)=b_{LTP}\cdot z^{-M} \tag{1}$$

where $b_{LTP}$ is the LTP predictor coefficient, and M is the predictor delay, usually referred to as the pitch lag. The predictor parameters (LTP coefficient and lag) can be determined by minimizing the mean squared error function. One way of defining the mean squared error function can be:

$$E=\sum_{i=0}^{N-1}[x(i)-b_{LTP}\cdot\tilde{x}(i-M)]^2 \tag{2}$$

where N is the frame size (in the time domain), x is the input signal segment and $\tilde{x}$ is the past reconstructed signal.

A preferred, optimum LTP predictor coefficient may be calculated as:

$$b_{LTP}=r/a \tag{3}$$

where $$a=\sum_{i=0}^{N-1}\tilde{x}(i+M)\cdot\tilde{x}(i+M) \tag{4}$$

$$r=\sum_{i=0}^{N-1}x(i)\cdot\tilde{x}(i-M)$$

The LTP lag can be determined by maximizing the normalized cross-correlation between x and $\tilde{x}$ over the specified lag range as follows:

$$M=\max\{C(\tau)\},\ 0\le\tau<N-1 \tag{5}$$

$$C(\tau)=\left\{\frac{\sum_{i=0}^{N-1}x(i)\cdot\tilde{x}(i-\tau)}{\sqrt{\sum_{i=0}^{N-1}\tilde{x}(i-\tau)^2}}\right\}$$

After the LTP lag has been determined, the predicted time domain signal can be calculated using the sample transfer function. Then, the predicted time domain signal can be converted to a frequency domain representation for the residual signal computation. In AAC, this time-to-frequency (t/f) transformation is normally a 1024-point modified discrete cosine transform (MDCT). In order to maximize the prediction gain, the difference signal can be obtained on a frequency band basis. If predictable components are present within the band, the difference signal can be used; otherwise that band can be left unmodified. This control can be implemented as a set of flags, which are transmitted in the bitstream along with the other predictor parameters.

As mentioned above, encoding methods, such as the one described above, tend to be slow or require an impractical amount of resources. This can be a particular in certain applications such as mobile communication devices where encoding speed and resource requirement can be particularly important issues. As such, there is a need for improved systems, methods, devices, and computer code products for encoding an audio signal which can reduce the encoding time and resources while still maintaining a high quality audio signal.

SUMMARY OF THE INVENTION

Embodiment of the invention relates to methods, computer code products, devices, modules, systems and encoders for determining pitch lag for a current frame of information in an AAC LTP encoding system. The embodiments can be configured for selecting a lag search window in the current frame in a vicinity of a previous frame lag, and calculating a pitch lag estimate in the lag search window for the current frame. Embodiments of the invention can also be configured for determining if the pitch lag estimate is unreliable and if the pitch lag estimate is determined to be unreliable, selecting a new lag search window and calculating a new pitch lag estimate in the new lag search window.

Selecting a new lag search can involve setting a lower search window corresponding to an area from the beginning of the current frame to the lower boundary of the search window, setting an upper search window corresponding to an area from the upper boundary of the search window to the end of the current frame, calculating a lower pitch lag for in the lower search window and an upper pitch lag in the upper window, selecting a new search window locator corresponding whichever of the lower pitch lag or upper pitch lag produces the maximum cross correlation, setting a new search window around the new search window locator, calculating a new pitch lag for the new search window, and selecting as a lag estimator whichever of the pitch lag or the new pitch lag that produces the maximum cross correlation. Determining if the pitch lag is reliable can include comparing cross correlation associated with pitch lag to an adaptive threshold.

In addition, embodiments of the invention can be configured for determining whether encoding gain can be achieved using prediction for the pitch lag and if not foregoing performing a time-to-frequency transformation. If it is determined that encoding gain can be achieved using prediction for the pitch lag, a time-to-frequency transformation can be performed, prediction can be evaluated in a frequency domain, and it can be determined whether to update the adaptive threshold.

These, as well as other features, aspects, and advantages of embodiment of the invention will be discussed in more detail with reference to the attached figures in the detailed description.

DETAILED DESCRIPTION OF THE PREFERRED EMBODIMENTS

Figure 1:
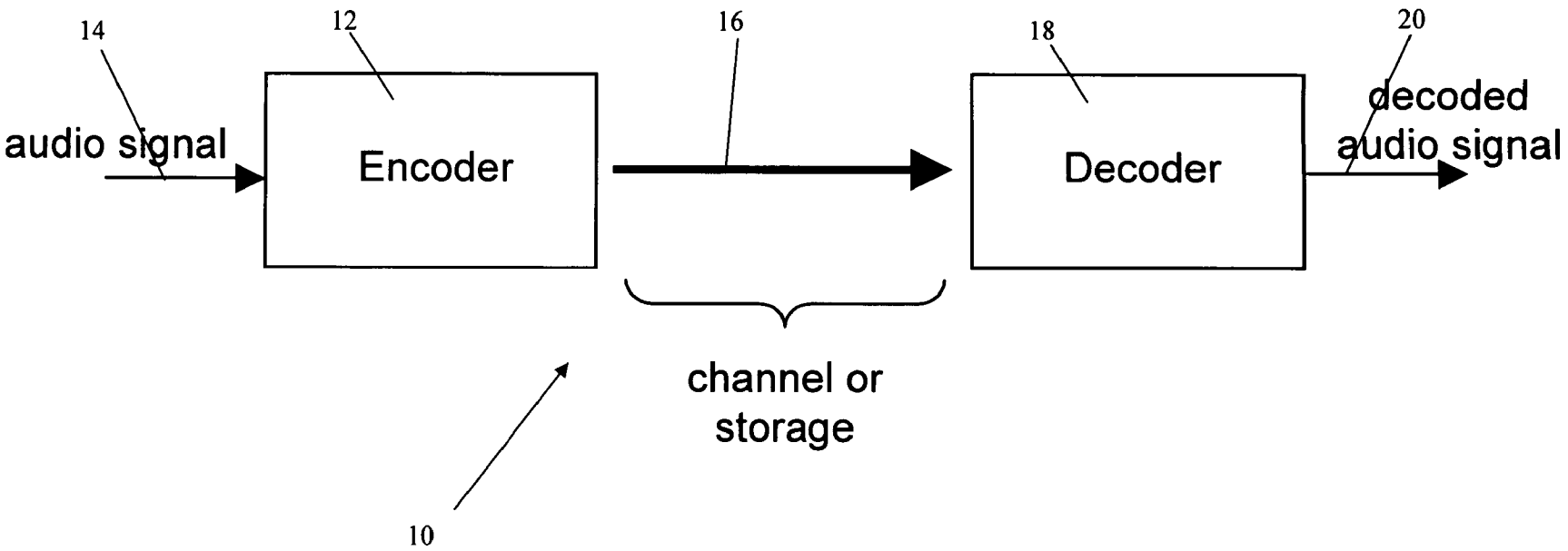
FIG. 1 is a block diagram of one embodiment of a system according to the present invention.

Referring to FIG. 1, one embodiment of an audio encoding system 10 is shown. The audio encoding system 10 includes an encoder 12 configured to encode an audio signal 14. After encoding, the encoder 12 may transmit the encoded signal on a transmission line 16 or may send the encoded signal to be saved as a file. A decoder 18 can also be included for receiving or loading the encoded signal and for decoding the encoded signal to for a reproduced (decoded) version 20 of the audio signal. In various embodiments of the system 10, the encoder 12 and/or decoder 18 may be included in a wireless or wireline communication system or some combination of both systems. Estimation of LTP lag according to the present invention may take place during AAC LTP encoding in both mobile devices, such as a mobile telephone having the ability to process audio signals or a digital radio, as well as in network devices such as a personal computer, audio file server or base station.

Figure 2:
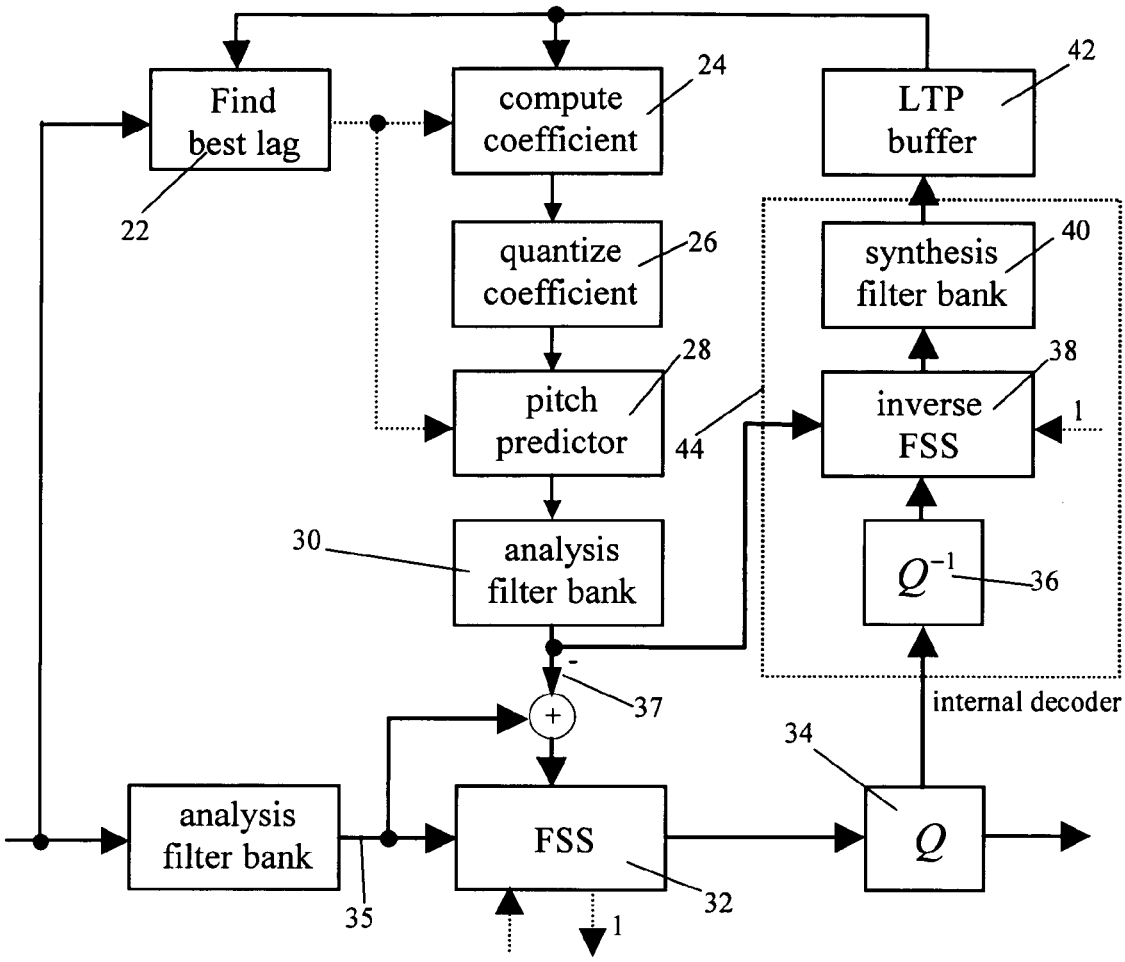
FIG. 2 is a block diagram of one embodiment of an encoder according to the present invention.

FIG. 2 shows a block diagram of one embodiment of an encoder 12 according to the present invention, in this case an AAC LTP encoder. First, the pitch lag can be estimated in block 22. Next, the predictor coefficient can be computed in block 24. The predictor coefficient can then be quantized, in block 26, so that the encoder and decoder can generate the same predicted signal under error-free conditions. After quantization of the predictor coefficient (or tap as it is also known), the predicted time domain frame can be obtained in block 28. The predicted frame can finally be transformed to time-frequency representation for the residual spectrum computation in block 30.

In order to guarantee that prediction is only used if this results in a prediction gain, an appropriate predictor control can be used, which can also transmitted be to the decoder 18. A Frequency Selective Switch (FSS) 32 can be used to calculate the predictor control parameters and the prediction gain. For the predictor control, the MDCT frames (original 35 and predicted 37) can be grouped into scalefactor bands, which are non-uniform regions of frequency. First, for each scalefactor band, a prediction gain can be determined, in block 34, and the prediction within the band can be activated if positive gain can be achieved, otherwise prediction can be discarded for that band. Finally, the overall prediction gain can be determined, in block 36, to see whether the gain compensates at least the predictor side information. If this is true, the residual spectrum can be formed for those scalefactor bands where prediction was activated. For the rest of the scalefactor bands, the input spectrum 35 can be used as such. If the overall prediction gain was negative, prediction can be discarded in the current frame and a single signaling bit can be transmitted to the decoder 18 signaling this. The prediction gain can be used to indicate the effect of using the predictor compared to the case of not using prediction at all.

After quantization, the time history buffer of LTP can be updated. The predicted spectral samples can be added to the inverse quantized spectrum (block 38), where activated, and finally passed to the synthesis filter bank (block 40). The oldest part of the buffer can be discarded and the current frame is stored to the buffer (block 42). As shown in FIG. 2, some of these operations can be done by the internal decoder 44 of the encoder 12.

Various aspects of embodiments of the present invention can be used to reduce the computational complexity involved in LTP lag estimation. For example, an adaptive search window can be used for lag estimation and an adaptive ¾ lag decision procedure with signal adaptive decision thresholds can be used to improve the performance and reduce the requirements of more traditional AAC encoding methods and in particular AAC LTP encoding methods.

In one embodiment, LTP lag estimation can be improved by using an adaptive search window to estimate the LTP lag in the vicinity of a previous lag. For example, if $M_{n-1}$ represents the LTP lag of frame n−1 (the previous frame), then the LTP lag for frame n (the current frame) can be determined by first estimating the optimum LTP lag in the vicinity of previous lag as follows:

$$M_{n_1}=\max\{C(\tau)\},\ M_{n-1}-m_1\leqq\tau\leqq M_{n-1}+m_2 \tag{6}$$

where $m_1$ and $m_2$ describe the boundaries of an adaptive search window. In one embodiment, these values can be set to 64 and 256, respectively.

LTP lag estimation can further be improved by comparing the cross-correlation associated with lag $M_{n_1}$ to an adaptive threshold $T_1$ to determine if the lag $M_{n_1}$ is reliable. Lag $M_{n_1}$ can be considered unreliable if following is valid:

$$\text{Unreliable}(M_{n_1})=\begin{cases}1, & C(M_{n_1})>T_0 \text{ and } xCorr(C(M_{n_1}))==0\\ 0, & \text{otherwise}\end{cases} \tag{7}$$

$$xCorr(ltpCorr)=\begin{cases}1, & LTP_{flags}==0 \text{ and } ltpCorr > 10^{0.125}\cdot ltpCorr_{AVE} \text{ or } ltpCorr < T_1\cdot ltpCorr_{AVE} \text{ and } LTP_{flags}\,!=255\\ 0, & \text{otherwise}\end{cases}$$

where $T_0$ is the minimum allowed cross-correlation level, $LTP_{flags}$ is a binary array indicating whether LTP was enabled ('1') or disabled ('0') in each of a certain number of past frames (8 frames in one embodiment of the invention), and $ltpCorr_{AVE}$ is the average cross-correlation of the selected LTP lag for a past number frames (3 frames in one embodiment of the invention. In one embodiment, the value $T_0$ can be set to 1.05e+05.

If Equation (7) indicates lag $M_{n_1}$ is reliable (returns value 0), some additional post-processing checks can be made to increase the reliability that prediction gain can be achieved with the selected lag. In one embodiment, these post-processing steps can include the following:

$$M_{n_{out}}=\begin{cases}M_{n_1}, & LTP_{flags}==0 \text{ and } C(M_{n_1})>10^{0.125}\cdot ltpCorr_{AVE} \text{ and } C(M_{n_1})>T_0 \text{ or } C(M_{n_1})>T_0\\ 0, & \text{otherwise}\end{cases} \tag{8}$$

$$LTP_{goodness}=\begin{cases}0, & LTP_{flags}\,\&15==0 \text{ and } C(M_{n_1})<1.525\cdot T_0 \text{ or } LTP_{flags}\,\&31==0\\ 1, & \text{otherwise}\end{cases}$$

If lag estimation returns a non-zero lag, a decision can be made whether or not to determine the prediction error spectrum for the current frame. This decision is made so that the prediction error spectrum is only determined when there are reasonable grounds to assume that by transmitting the error, encoding gain can be achieved. The LTP lag and coefficient can be used to obtain the predicted time domain signal but in AAC encoding the prediction error is usually transmitted as a frequency domain signal. Since the time to frequency transformation usually represents a relatively significant amount of computation, it can be beneficial to minimize the number of time to frequency transformations. In one embodiment, the number of time to frequency transformations can be minimized as follows:

$$LTP_{enable}=\begin{cases}1, & LTP_{goodness}==1 \text{ or } eError<T_2\\ 0, & \text{otherwise}\end{cases} \tag{9}$$

$$eError=\frac{\sum_{i=0}^{N-1}(x(i)-y(i))^2}{\sum_{i=0}^{N-1}x(i)^2}\cdot eGain$$

$$eGain=\begin{cases}g, & LTP_{goodness}==0\\ 1, & \text{otherwise}\end{cases}$$

$$g=10^{\sum\left(k\cdot 0.025\cdot(LTP_{flags}\&j)\right)_{j=16,32,64,128}^{k=1,3,6,10}}$$

where y is the predicted time domain signal obtained according to Equation (1), and $T_2$ is the signal threshold for the time domain energies. In one embodiment, the value of $T_2$ can be set to 0.5.

If $LTP_{enable}$ returns 0, LTP can be discarded for the current frame and therefore no error spectrum needs to be computed. Otherwise, the prediction error can be evaluated in the frequency domain. In any case, the value $M_{n_1}$ can be stored for computation of the LTP lag in the next frame.

If Equation (7) returns a non-reliable LTP lag estimator, further LTP lag estimation can be performed. First, optimum lag estimators can be obtained for lag ranges N−1, . . . $M_{n_1}$+1 and $M_{n_1}$−1, . . . ,0 using Equation (5). The estimators can be calculated on a coarse grid, that is, the lag increase/decrease can be more than unity. In one embodiment, the size of the grid can be set to 3 meaning that possible lag positions for the first and second lag range can be $M_{n_1}$+1, $M_{n_1}$+4, $M_{n_1}$+7, . . . , N−1 and $M_{n_1}$−1, $M_{n_1}$−4, $M_{n_1}$−7, . . . ,0, respectively.

Next, the lag that gives the maximum cross-correlation of the two lags can be selected as follows:

$$M_{n_2}=\begin{cases}\tau_1, & C_1(\tau_1)>C_2(\tau_2)\\ \tau_2, & \text{otherwise}\end{cases} \tag{10}$$

$$C_1(\tau)=\max\{C(\tau)\},$$

$$\tau=M_{n_1}+1,\ M_{n_1}+4,\ M_{n_1}+7,\ \ldots,\ N-1$$

$$C_2(\tau)=\max\{C(\tau)\},$$

$$\tau=M_{n_1}-1,\ M_{n_1}-4,\ M_{n_1}-7,\ \ldots,\ 0$$

and the search window can be narrowed to a range of ±W around $M_{n_2}$. In one embodiment, the value of ±W can be set to ±64. The optimum lag for this new window can be calculated if cross-correlation satisfies the following:

$$LTP_{enable_new_window}=\begin{cases}1, & xCorr==1\\ 0, & \text{otherwise}\end{cases} \tag{11}$$

-continued $$xCorr = \begin{cases} 1, & \begin{matrix} \max(C(M_{n_1}), C(M_{n_2})) > T_0 \\ \text{and} \\ C(M_{n_2}) > w \cdot C(M_{n_1}) \end{matrix} \\ 0, & \text{otherwise} \end{cases}$$

where w is an implementation dependent constant. In one embodiment, the value of w can be set to 1.05.

Finally, the lag estimator can be selected as the lag value that gives the maximum cross-correlation as follows:

$$M_{n_1} = \begin{cases} M_{n_3}, & LTP_{enable_new_window} == 1 \text{ and } xCorr == 1 \\ M_{n_1}, & \text{otherwise} \end{cases} \tag{12}$$

$$xCorr = \begin{cases} 1, & C(M_{n_3}) > C(M_{n_1}) \\ 0, & \text{otherwise} \end{cases}$$

$$M_{n_3} = \max\{C(\tau)\},\ M_{n_2} - W \le \tau \le M_{n_2} + W$$

After this, processing can continue from Equation (8).

AAC generally supports two frequency resolutions, 128- and 1024-point MDCTs.

The former is commonly used for efficient handling of transient signals segments and the latter is typically used when (quasi)-stationary signal segments are present to achieve high energy compaction. The AAC standard specifies that LTP can be used only with 1024-point MDCT. As such, if 128-point MDCT is applied for the current frame, LTP does not need to be computed. If this is the case, an LTP lag would not be available from a previous frame when switching from 128-point MDCT to 1024-point MDCT. To handle this situation in the LTP lag estimation routine, a dummy lag value, such as −1, can be used to indicate that previous lag value is not known. If the dummy lag value is encountered, the lag can be estimated as follows:

First, the optimum lag value can be determined on a coarse grid for the whole lag range 0, . . . , N−1. In one embodiment, the size of the grid can be set to 4. Next, the lag search window can again be narrowed and final lag can be obtained according to:

$$M_{n_{out}} = \begin{cases} M_{n_1}, & C(M_{n_1}) > T_0 \\ 0, & \text{otherwise} \end{cases} \tag{13}$$

$$M_{n_1} = \max\{C(\tau)\},\ M_{n_4} - n_1 \le \tau \le M_{n_4} + n_2$$

$$M_{n_4} = \max\{C(\tau)\},\ \tau = 0, 4, 8, 12, 16, 20, \ldots, N-1$$

where $n_1$ and $n_2$ specify the boundaries of the final search window. In one embodiment, these values can be set to 56 and 70, respectively. After this, processing can continue by calculating the $LTP_{goodness}$ value according to Equation (8).

If a reliable LTP lag is calculated and post processing determines that it worthwhile to perform a time-to-frequency transformation, the prediction error can be evaluated in the frequency domain. In one embodiment, this can include calculating the error spectrum for each frequency band and deciding whether prediction should be enabled for the band or not. In one embodiment, prediction is not used if coding the error requires more bits than the original spectra. The number of bits required for the error and original spectral samples can be calculated based on the perceptual entropies of the signals or based signal-to-noise (SNR) values. In one embodiment, described below, SNR values are used. The number of bits saved by transmitting the error spectral samples instead of the original spectral samples for a given frequency band (sfb) can be calculated as follows:

$$numBit(sfb) = \begin{cases} GainBits(sfb), & SNR(sfb) > 3.0 \\ 0.0, & \text{otherwise} \end{cases} \tag{14}$$

$$SNR(sfb) = -10 \cdot \log_{10}\left( \frac{\sum_{b=0}^{sfbWidth} (x_{MDCT}(sfbOffset + b) - y_{MDCT}(sfbOffset + b))^2}{\sum_{b=0}^{sfbWidth} x_{MDCT}(sfbOffset + b)^2} \right)$$

$$GainBits(sfb) = \frac{SNR(sfb)}{6}$$

where sfbWidth is the width of the corresponding frequency band, sfbOffset is the offset to the start of the corresponding frequency band, and $x_{MDCT}$ and $y_{MDCT}$ are MDCT representations of the original time signal and predicted time signal, respectively. The total number of bits saved by using LTP prediction can be obtained by accumulating Equation (14) across each frequency band. The adaptive threshold $T_1$ related to cross-correlation can be adjusted as follows:

$$T_1 = \begin{cases} gainA, & numBitsAll > nSfb + 14 \\ gainB, & \text{otherwise} \end{cases} \tag{15}$$

$$numBitsAll = \sum_{sfb=0}^{nSfb} numBits(sfb)$$

where nSfb describes the total number of frequency bands present in the frame, and gainA and gainB are determined according to following pseudo-code:

```
/*-- gainA : Adjust correlation threshold. --*/
thrGain = (FLOAT) (numBitsAll / (1.5 * (nSfb + 14)) * 0.25f);
if(T1 < 1.0) T1 = 1.0;
    if((T1 + thrGain) > 1.85)
        gainA = 1.85;
    else
        gainA = T1 + thrGain;
/*-- gainB : Adjust correlation threshold. --*/
thrGain = ((nSfb + 14) / numBitsAll) * 0.25f;
if(T1 − thrGain > 0.0f)
    gainB = MAX(0.3, T1 − thrGain);
else
    gainB = 0.3;
```

It should be noted that $T_1$ can be set to a unity value at the start of encoding.

Embodiments of the present invention can provide a significant improvement in encoding speed with no degradation in performance of the LTP encoding tool.

Embodiments of the invention can be used for lag estimation in a closed loop context. In a closed loop lag estimation, the past reconstructed time signal can be used to obtain the improvements in performance, whereas in an open loop estimation only the input signal can be used to obtain an estimation of lag.

Figure 3:
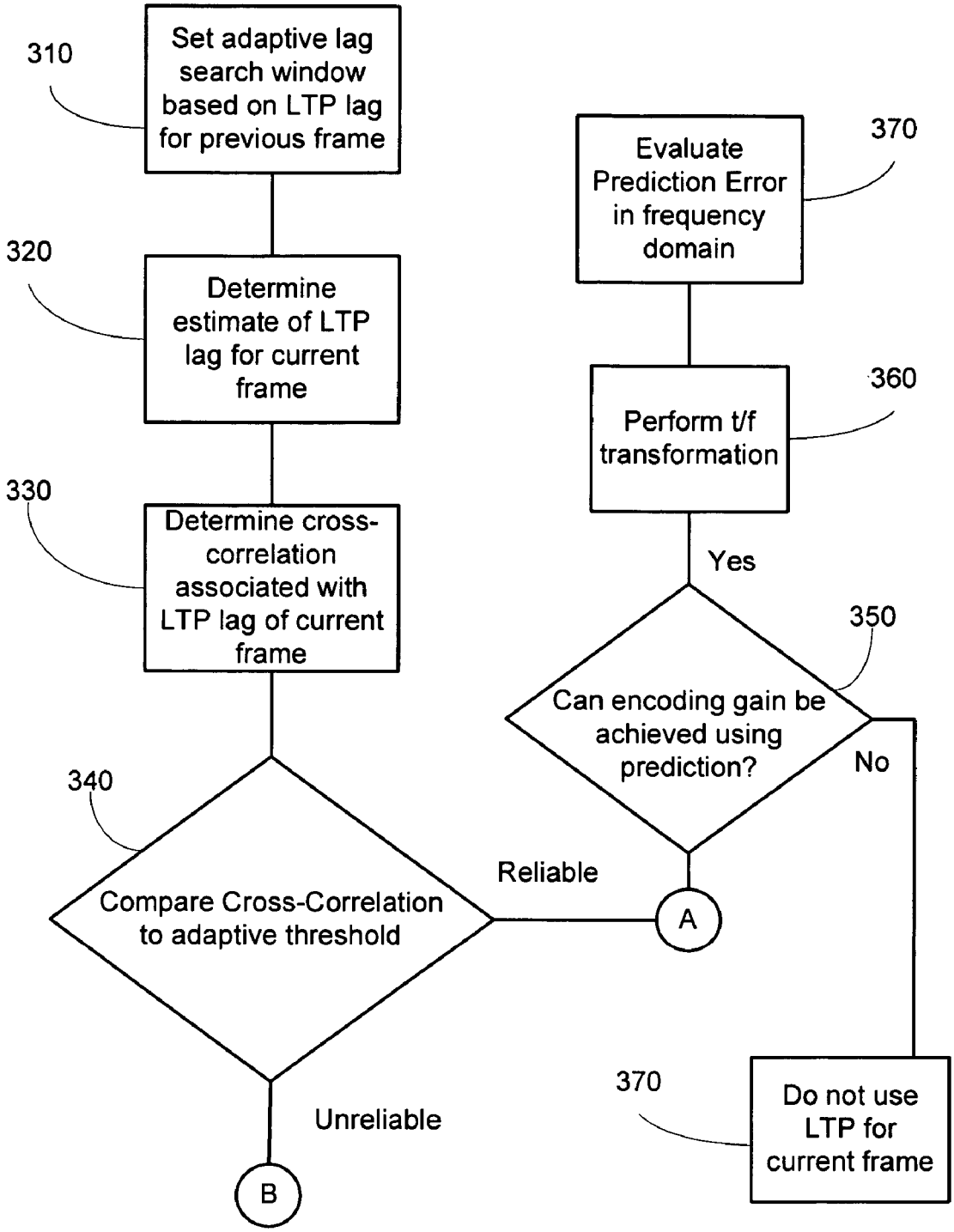
FIG. 3 is a flow diagram of one embodiment of a method according to the present invention.
Figure 4:
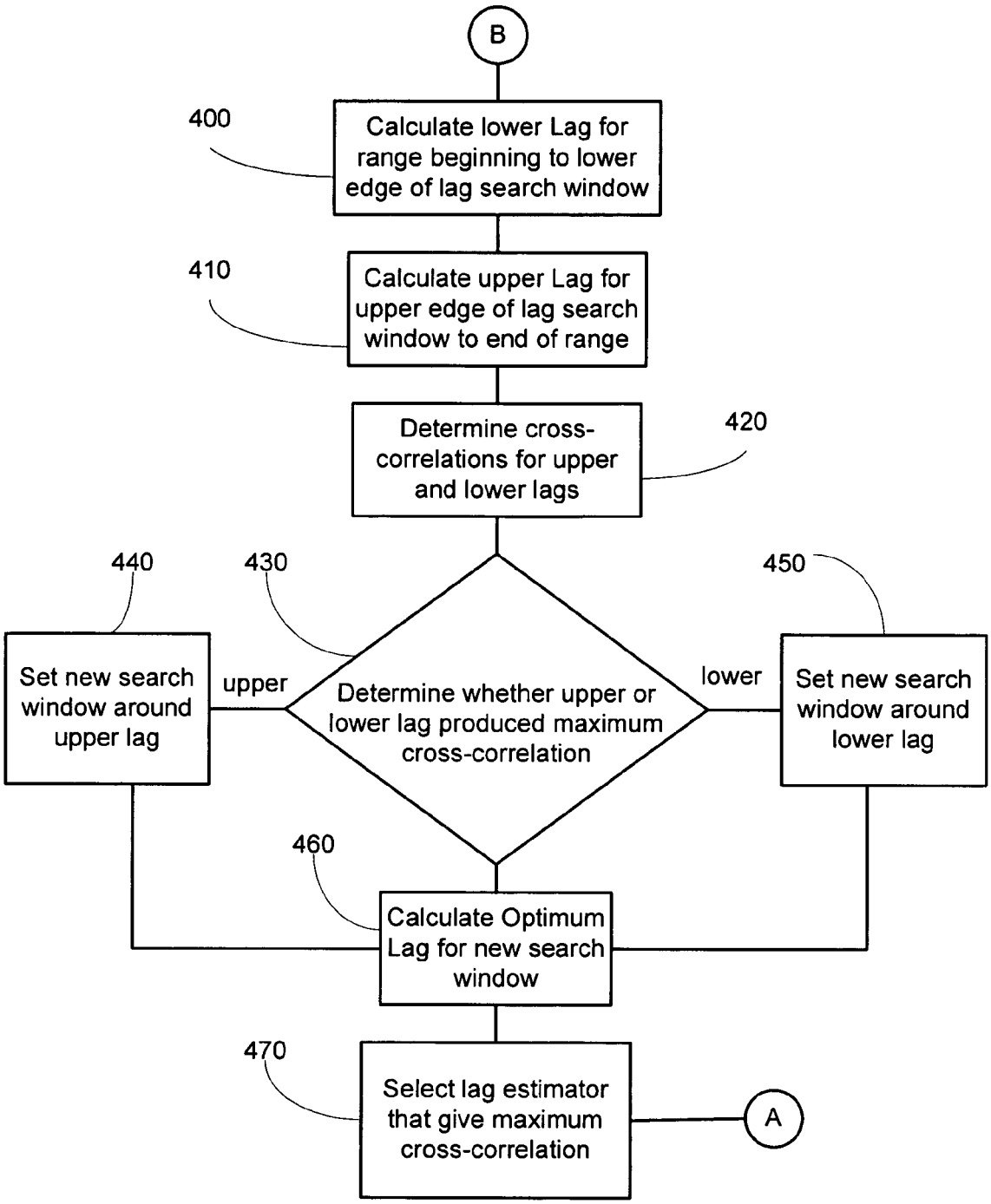
FIG. 4 is a continuation of the flow diagram of FIG. 3.

FIGS. 3 and 4 illustrate one embodiment of a method according to the present invention. The method illustrated in FIGS. 3 and 4 includes an improved method for determining LPT lag. Instead of calculating an LTP lag an entire frame, an adaptive lag search window is set, in block 310, in the vicinity of the previous frame lag. An estimate of the optimum LTP lag can be calculated using the adaptive lag search window, in block 320, and the cross-correlation associated with the determined optimum LTP lag can be calculated in block 330. This cross-correlation can be compared to an adaptive threshold, in block 340, to determine if the calculated LTP lag is reliable as described in more detail above.

If the LTP lag is determined to be reliable, a determination can be made, in block 350, whether encoding gain can be achieved by using the prediction. If it can, a time-to-frequency transformation can be made, in block 360, to determine the prediction error spectrum, and the prediction error can then be evaluated in the frequency domain in block 370 If it is determined that encoding gain can not be achieved, the LTP can be discarded, in block 380, and there is no need to compute the prediction error spectrum, thus saving valuable computation time and resources.

Figure 5:
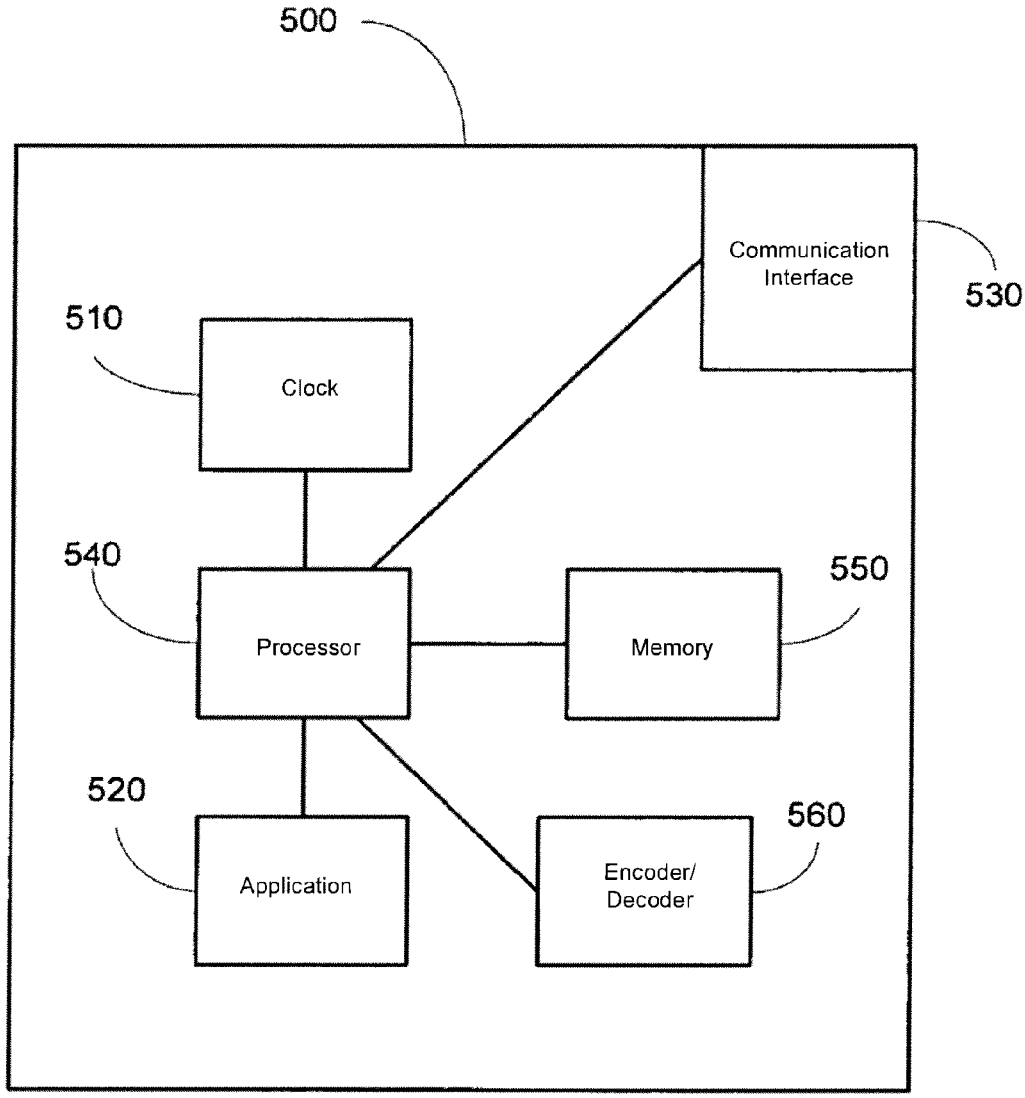
FIG. 5 is a block diagram of one embodiment of a device according to the present invention.

If is it determined that the LTP lag estimate based on original adaptive search window is unreliable, a new adaptive search window can be selected. In one embodiment, this can include calculating lag estimates for the ranges below and above the old adaptive search window. In other words, a lower lag can be calculated based on the area from the beginning of the range to the lower limit of the old adaptive lag window, in block 400, and an upper lag can be calculated based on the area from the upper limit of the old adaptive lag window to the upper end of the range, in block 410. Cross-correlations can be computed for each of the upper and lower lags, in block 420, and a determination can be made whether the upper or lower lags produce the maximum cross-correlation, in block 430. If the upper lag produces the maximum cross-correlation, a new search window can be selected around the upper lag, in block 440. If the lower lag produces the maximum cross-correlation, a new search window can be selected around the lower lag, in block 450. After selecting the new search window, a new optimum lag can be calculated for the new search window, in block 460. Then the lag estimator that produces the maximum cross-correlation, either the new optimum lag estimator or the original lag estimator calculated using the search window based on the previous frame lag can be selected in block 470. After selecting the lag estimator, in block 470, the algorithm can return to block 350 to determine if encoding gain can be achieved using the selected prediction and the appropriate subsequent steps can be followed based on the determination made in block 350. Referring now to FIG. 5, the present invention can be implemented as part of a mobile or network communication device. Exemplary mobile communication devices include, but are not limited to a mobile MP3/AAC player, a compact disk player, a PDA, a PC or a cellular telephone with audio-processing capability. Exemplary network communication devices include, but are not limited to a base station, a personal computer or audio file server. A communication device 500, as shown in FIG. 5, can comprise a clock 510, an application 520, a communication interface 530, a processor 540, a memory 550, and an encoder/decoder 560. The exact architecture of the communication device is not important, and different and additional components may be incorporated into the communication device. The lag estimation technique of the present invention may be performed in the processor 540, memory 550, and encoder/decoder 560 of the communication device 500.

The memory 550 which aids the processor 540 and application 520 in carrying out the present invention could be, but is not limited to, Random Access Memory (RAM), Read Only Memory (ROM) or flash memory. The processor 540, which could carry out the present invention, could be implemented in either software or hardware. The applications 520 for which the present invention could be used include, but are not limited to, applications facilitating Internet audio transmission and streaming and the operation of digital radio and audio players.

Another possible implementation of the present invention is as part of a computer code product involved in carrying put the method of the present invention. A computer code product comprises computer readable code and a computer readable storage medium. The computer readable code is the set of instructions that dictates the operations that the processor takes according to the present invention. The computer readable code may be written using a computer language such as, a high-level language such as C or C++ or a low-level language such as a machine language or an assembly language. The computer readable storage medium is the location in which the computer code product can be captured. Exemplary computer readable storage mediums may include, but are not limited to, magnetic tape, computer diskettes, hard drives, memory, and paper on which the program can be written and transferred to and run on any machine capable of processing the computer readable code.

Another possible implementation of the present invention is as a module. A module can be an optionally connected or installed plug-in that enables another device to carry out LTP lag estimation within AAC LTP encoding. The module could be in the form of hardware or software or as a combination of hardware and software. It should be noted that the word "module" as used herein and in the claims is intended to encompass implementations that can use one or more lines of software code, and/or hardware implementations, and/or equipment for receiving manual inputs. It is to be understood that an AAC encoding method is used here only as an example, the invention is also applicable to other encoding methods, in which lag estimation is needed in context of predictive coding.

While exemplary embodiments are illustrated in the figures and described herein, it should be understood that these embodiment are offered by way of example only.

Other embodiment may include, for example, different techniques for performing the same operations. The invention is not limited to a particular embodiment, but extends to various modifications, combinations, and permutations that nevertheless fall within the scope and spirit of the appended claims.

What is claimed is:

1. A method for determining pitch lag for a current frame of information in a long term prediction (LTP) encoding system, the method comprising:

selecting a lag search window for the current frame in a vicinity of a previous frame pitch lag, the lag search window having an upper boundary and a lower boundary;

calculating, by a processor associated with the LTP encoding system, a pitch lag estimate in the lag search window for the current frame;

determining if the pitch lag estimate is unreliable based in part on an average cross-correlation for a plurality of previous frames; and upon determination of the pitch lag estimate to be unreliable, selecting a new lag search window and calculating a new pitch lag estimate in the new lag search window.

2. The method of claim 1, wherein the selecting of the new lag search window comprises:

calculating a lower pitch lag for a lag range N−1, . . . , $M_{n1}$+1 and calculating an upper pitch lag for a lag range $M_{n1}$−1, . . . , 0, where $M_{n1}$ represents the pitch lag estimate and N is frame size in the time domain;

selecting a new search window locator corresponding to the one of either the lower pitch lag or upper pitch lag that produces a maximum cross correlation;

setting a new search window around the new search window locator;

calculating a new pitch lag for the new search window; and selecting as a lag estimator the one of either the pitch lag or the new pitch lag that produces a maximum cross correlation.

3. The method of claim 1, wherein the determining if the pitch lag is unreliable is also based in part on a comparison of a cross correlation associated with the pitch lag to an adaptive threshold.

4. The method of claim 1, further comprising determining whether encoding gain can be achieved using prediction for the pitch lag estimate, and if the encoding gain cannot be achieved, foregoing performing a time-to-frequency transformation.

5. The method of claim 3, further comprising determining whether encoding gain can be achieved using prediction for the pitch lag estimate, and if encoding gain can be achieved performing a time-to-frequency transformation, evaluating prediction in a frequency domain, and determining whether to update the adaptive threshold.

6. A computer program product for determining pitch lag for a current frame of information in a long term prediction (LTP) encoding system, the computer program product comprising:

computer readable code and a non-transitory computer readable storage medium configured for:

selecting a lag search window for the current frame in a vicinity of a previous frame pitch lag, the lag search window having an upper boundary and a lower boundary;

calculating a pitch lag estimate in the lag search window for the current frame;

determining if the pitch lag estimate is unreliable based in part on an average cross-correlation for a plurality of previous frames; and upon determination of the pitch lag estimate to be unreliable, selecting a new lag search window and calculating a new pitch lag estimate in the new lag search window.

7. The computer program product of claim 6, wherein the selecting of the new lag search window comprises:

calculating a lower pitch lag for a lag range N−1, . . . , $M_{n1}$+1 and calculating an upper pitch lag for a lag range $M_{n1}$−1, . . . , 0, where $M_{n1}$ represents the pitch lag estimate and N is frame size in the time domain;

selecting a new search window locator corresponding to the one of either the lower pitch lag or upper pitch lag that produces a maximum cross correlation;

setting a new search window around the new search window locator;

calculating a new pitch lag for the new search window; and selecting as a lag estimator the one of either the pitch lag or the new pitch lag that produces a maximum cross correlation.

8. The computer program product of claim 6, wherein the determining if the pitch lag estimate is unreliable is also based in part on a comparison of a cross correlation associated with the pitch lag estimate to an adaptive threshold.

9. The computer program product of claim 6, further comprising computer readable code configured for determining whether encoding gain can be achieved using prediction for the pitch lag estimate, and if encoding gain cannot be achieved, foregoing performing a time-to-frequency transformation.

10. The computer program product of claim 8, further comprising computer readable code configured for determining whether encoding gain can be achieved using prediction for the pitch lag estimate, and if encoding gain can be achieved, performing a time-to-frequency transformation, evaluating prediction in a frequency domain, and determining whether to update the adaptive threshold.

11. A device for determining pitch lag for a current frame of information in a long term prediction (LTP) encoding system, the encoder comprising:

a processor;

a memory communicatively coupled to the processor; and an encoder communicatively coupled to the processor and configured for:

selecting a lag search window for the current frame in a vicinity of a previous frame pitch lag, the lag search window having an upper boundary and a lower boundary;

calculating a pitch lag estimate in the lag search window for the current frame;

determining if the pitch lag estimate is unreliable based in part on an average cross-correlation for a plurality of previous frames; and upon determination of the pitch lag estimate to be unreliable, selecting a new lag search window and calculating a new pitch lag estimate in the new lag search window.

12. The device of claim 11, wherein the selecting of the new lag search window comprises:

calculating a lower pitch lag for a lag range N−1, . . . , $M_{n1}$+1 and calculating an upper pitch lag for a lag range $M_{n1}$−1, . . . , 0, where $M_{n1}$ represents the pitch lag estimate and N is frame size in the time domain;

selecting a new search window locator corresponding to the one of either the lower pitch lag or upper pitch lag that produces a maximum cross correlation;

setting a new search window around the new search window locator;

calculating a new pitch lag for the new search window; and selecting as a lag estimator the one of either the pitch lag or the new pitch lag that produces a maximum cross correlation.

13. The device of claim 11, wherein the determining if the pitch lag estimate is unreliable is also based in part on a comparison of a cross correlation associated with the pitch lag estimate to an adaptive threshold.

14. The device of claim 11, wherein the encoder is further configured for determining whether encoding gain can be achieved using prediction for the pitch lag estimate, and if encoding gain cannot be achieved foregoing performing a time-to-frequency transformation.

15. The device of claim 13, wherein the encoder is further configured for determining whether encoding gain can be achieved using prediction for the pitch lag estimate, and if encoding gain can be achieved performing a time-to-frequency transformation, evaluating prediction in a frequency domain, and determining whether to update the adaptive threshold.

16. A tangible plug-in module configured for determining pitch lag for a current frame of information in a long term prediction (LTP) encoding system, the module comprising:

an encoder configured to:

select a lag search window for the current frame in a vicinity of a previous frame pitch lag, the lag search window having an upper boundary and a lower boundary;

calculate a pitch lag estimate in the lag search window for the current frame;

determine if the pitch lag estimate is unreliable based in part on an average cross-correlation for a plurality of previous frames; and upon determination of the pitch lag estimate to be unreliable, select a new lag search window and calculate a new pitch lag estimate in the new lag search window.

17. The module of claim 16, wherein the encoder is further configured to:

calculate a lower pitch lag for a lag range $N-1, \ldots, M_{n1}+1$ and calculating an upper pitch lag for a lag range $M_{n1}-1, \ldots, 0$, where $M_{n1}$ represents the pitch lag estimate and N is frame size in the time domain;

select a new search window locator corresponding to the one of either the lower pitch lag or upper pitch lag that produces a maximum cross correlation;

set a new search window around the new search window locator;

calculate a new pitch lag for the new search window; and select as a lag estimator the one of either the pitch lag or the new pitch lag that produces a maximum cross correlation.

18. The module of claim 16, wherein the determining if the pitch lag is unreliable is also based in part on a comparison of a cross correlation associated with pitch lag to an adaptive threshold.

19. The module of claim 16, wherein the encoder is further configured to determine if encoding gain can be achieved using prediction for the pitch lag, and if encoding gain cannot be achieved, foregoing performing a time-to-frequency transformation.

20. The module of claim 18, wherein the encoder is further configured to determine if encoding gain can be achieved using prediction for the pitch lag, and if encoding gain can be achieved, perform a time-to-frequency transformation, evaluate prediction in a frequency domain, and determine whether to update the adaptive threshold.

21. An audio encoding device for encoding an audio signal, the audio encoding device comprising:

a communication interface configured to receive the audio signal;

a processor; and a computer-readable storage medium including computer-readable instructions stored therein that, upon execution by the processor, cause the audio encoding device to:

determine pitch lag for a current frame of information in long term prediction (LTP) encoding system by selecting a lag search window for a current frame of audio information in a vicinity of a previous frame pitch lag, the lag search window having an upper boundary and a lower boundary;

calculate a pitch lag estimate in the lag search window for the current frame;

determine if the pitch lag estimate is unreliable based in part on an average cross-correlation for a plurality of previous frames; and upon determination of the pitch lag estimate to be unreliable, select a new lag search window and calculate a new pitch lag estimate in the new lag search window.

22. The audio encoding device of claim 21, wherein the selecting of the new lag search window comprises:

calculating a lower pitch lag for a lag range $N-1, \ldots, M_{n1}+1$ and calculating an upper pitch lag for a lag range $M_{n1}-1, \ldots, 0$, where $M_{n1}$ represents the pitch lag estimate and N is frame size in the time domain;

selecting a new search window locator corresponding to the one of either the lower pitch lag or upper pitch lag that produces a maximum cross correlation;

setting a new search window around the new search window locator;

calculating a new pitch lag for the new search window; and selecting as a lag estimator the one of either the pitch lag or the new pitch lag that produces a maximum cross correlation.

23. The audio encoding device of claim 21, wherein the determining if the pitch lag estimate is unreliable is also based on a comparison of a cross correlation associated with pitch lag to an adaptive threshold.

24. The audio encoding device of claim 21, wherein the computer-readable storage medium includes further computer-readable instructions that, upon execution by the processor, cause the audio encoding device to determine whether encoding gain can be achieved using prediction for the pitch lag estimate, and if encoding gain cannot be achieved, forego performing a time-to-frequency transformation.

25. The audio encoding device of claim 23, wherein the computer-readable storage medium includes further computer-readable instructions that, upon execution by the processor, cause the audio encoding device to determine whether encoding gain can be achieved using prediction for the pitch lag estimate, and if encoding gain can be achieved, perform a time-to-frequency transformation, evaluate prediction in a frequency domain, and determine whether to update the adaptive threshold.

* * * * *